US009057266B2

(12) United States Patent
Viitamäki et al.

(10) Patent No.: US 9,057,266 B2
(45) Date of Patent: Jun. 16, 2015

(54) ROTARY COMBUSTION ENGINE AND HYDRAULIC MOTOR

(75) Inventors: Tapio Viitamäki, Koskenkorva (FI); Markus Viitamäki, Koskenkorva (FI)

(73) Assignee: Greittek OY, Koakenkorva (FI)

( * ) Notice: Subject to any disclaimer, the term of this patent is extended or adjusted under 35 U.S.C. 154(b) by 528 days.

(21) Appl. No.: 12/934,179

(22) PCT Filed: Apr. 15, 2009

(86) PCT No.: PCT/FI2009/050281
§ 371 (c)(1),
(2), (4) Date: Oct. 4, 2010

(87) PCT Pub. No.: WO2009/127786
PCT Pub. Date: Oct. 22, 2009

(65) Prior Publication Data

US 2011/0017169 A1 Jan. 27, 2011

(30) Foreign Application Priority Data

Apr. 17, 2008 (FI) ..... 20085326

(51) Int. Cl.
*F02B 53/04* (2006.01)
*F02B 53/00* (2006.01)
(Continued)

(52) U.S. Cl.
CPC ..... *F01C 1/3442* (2013.01); *F01C 1/348* (2013.01); *F01C 21/0836* (2013.01); *F03C 2/304* (2013.01)

(58) Field of Classification Search
CPC ..... F02B 53/00; F01C 1/3564; F01C 1/3566; F01C 21/106; F01C 21/0809; F01C 11/008; F01C 1/3442; F01C 1/348; F01C 1/0836; F04C 14/226; F04C 2/344
USPC ..... 123/242, 18 R, 240, 220, 231, 243, 43 C; 418/61.1, 265, 260, 261, 264
See application file for complete search history.

(56) References Cited

U.S. PATENT DOCUMENTS 1,291,618 A * 1/1919 Olson ..... 418/265
1,549,515 A * 8/1925 Smith ..... 418/145
(Continued)

FOREIGN PATENT DOCUMENTS

DE 20 15 936 A * 4/1970 ..... F01C 1/34
DE 2 316 529 A1 10/1974
(Continued)

OTHER PUBLICATIONS

Chinese Office Action issued in Chinese Application No. 200980000103.5 dated Jul. 20, 2012 (w/translation).
(Continued)

*Primary Examiner* — Thai Ba Trieu
*Assistant Examiner* — Jason T Newton
(74) *Attorney, Agent, or Firm* — Oliff PLC

(57) ABSTRACT

A rotary engine and a hydraulic motor including non-rotary outer and inner casings; a power shaft with an eccentric part; a driving eccentric ring between the outer and inner casings and mounted on the eccentric part; a combustion or pressure chamber between the eccentric ring and the inner casing such that the eccentric ring drives the power shaft by substantially non-rotating eccentric movement; dividers for dividing the combustion chamber into at least two parts, the dividers extend through the inner casing and are in contact with an inner surface of the driving eccentric ring; and an eccentric device (or control) for driving the dividers back and forth with respect to the inner casing. The eccentricity of the eccentric device corresponds with the eccentricity of the eccentric part of the power shaft. The eccentric device has a guide groove which implements an eccentric path and to which the dividers are connected.

16 Claims, 3 Drawing Sheets

(51) Int. Cl.

| | |
|---|---|
| ***F01C 1/344*** | (2006.01) |
| ***F01C 1/348*** | (2006.01) |
| ***F01C 21/08*** | (2006.01) |
| ***F03C 2/30*** | (2006.01) |

(56) References Cited

U.S. PATENT DOCUMENTS

| | | | | | |
|---|---|---|---|---|---|
| 1,974,761 | A | * | 9/1934 | Vogel | 123/243 |
| 3,001,482 | A | * | 9/1961 | Osborn | 418/85 |
| 3,485,179 | A | | 12/1969 | Dawes | |
| 3,902,465 | A | * | 9/1975 | Stookey | 123/222 |
| 3,936,252 | A | * | 2/1976 | Maher | 418/173 |
| 3,951,112 | A | * | 4/1976 | Hunter | 123/242 |
| 3,955,540 | A | * | 5/1976 | Blanchard | 418/260 |
| 4,212,603 | A | * | 7/1980 | Smolinski | 418/256 |
| 4,410,305 | A | * | 10/1983 | Shank et al. | 418/150 |
| 4,997,351 | A | * | 3/1991 | Sakamaki et al. | 418/152 |
| 4,998,867 | A | * | 3/1991 | Sakamaki et al. | 418/256 |
| 5,002,473 | A | * | 3/1991 | Sakamaki et al. | 418/257 |
| 5,074,769 | A | * | 12/1991 | Kazaoka et al. | 418/61.1 |
| 5,087,183 | A | * | 2/1992 | Edwards | 418/265 |
| 5,169,298 | A | * | 12/1992 | Hekman et al. | 418/1 |
| 5,415,141 | A | * | 5/1995 | McCann | 123/243 |
| 5,634,783 | A | | 6/1997 | Beal | |
| 6,010,322 | A | | 1/2000 | Lai | |
| 6,616,433 | B1 | * | 9/2003 | Simonds | 418/265 |
| 7,192,264 | B2 | | 3/2007 | Viitamäki | |
| 7,350,500 | B1 | * | 4/2008 | Webb | 123/200 |
| 8,336,518 | B2 | * | 12/2012 | Sleiman et al. | 123/243 |
| 2001/0055538 | A1 | * | 12/2001 | Schneider et al. | 418/265 |
| 2004/0094101 | A1 | * | 5/2004 | Viitamaki | 123/18 R |
| 2005/0232801 | A1 | * | 10/2005 | Viitamaki | 418/125 |
| 2005/0274350 | A1 | * | 12/2005 | Gorski | 123/240 |

FOREIGN PATENT DOCUMENTS

| | | | | | |
|---|---|---|---|---|---|
| DE | 2316529 | A | * | 10/1974 | |
| DE | 31 08 087 | A | * | 9/1982 | F01C 1/344 |
| FI | 110807 | B | | 3/2003 | |
| FI | 114235 | B | | 9/2004 | |
| GB | 342264 | A | * | 1/1931 | 123/240 |
| WO | WO 87/07675 | A1 | | 12/1987 | |
| WO | WO 03/091545 | A1 | | 11/2003 | |

OTHER PUBLICATIONS

International Search Report in International Patent Application No. PCT/FI2009/050281, dated Jul. 2, 2009.

International Preliminary Report on Patentability in International Application No. PCT/FI2009/050281, dated Jun. 23, 2010.

Search Report in Finnish Patent Application No. 20085326, dated Mar. 16, 2009 (with English translation).

Aug. 8, 2014 Extended European Search Report issued in European Application No. 09733643.2.

* cited by examiner

ROTARY COMBUSTION ENGINE AND HYDRAULIC MOTOR

BACKGROUND OF THE INVENTION

The invention relates to a rotary combustion engine comprising a non-rotary outer casing; a non-rotary inner casing; a power shaft provided with an eccentric part; a driving eccentric ring provided between the outer casing and the inner casing and mounted in bearings on the eccentric part of the power shaft; a combustion chamber arrangement for burning a mixture of fuel and air supplied into the engine between the eccentric ring and the inner casing such that the eccentric ring drives the power shaft by means of substantially non-rotating eccentric movement; divider members for dividing the combustion chamber arrangement into at least two parts of equal size, whereby the divider members extend through the inner casing and are in close contact with an inner surface of the driving eccentric ring; an eccentric device or control for driving the divider members back and forth with respect to the inner casing, whereby the eccentricity of the eccentric device or control corresponds with the eccentricity of the eccentric part of the power shaft.

The invention also relates to a hydraulic motor, whereby in the above-described arrangement, in place of the combustion chamber arrangement, a pressure chamber arrangement is provided between the eccentric ring and the inner casing for conveying hydraulic fluid thereto and therefrom.

Such an engine and motor are known from Finnish Patents No. 110807 and 114235.

A problem with the solutions described in these patents is that the distance between the sealing surface of the divider members and the inner surface of the driving, i.e. the first, eccentric ring does not remain constant, owing to the paths of the system. This is because the divider members are slightly inclined towards their matching surfaces for the most of the time; they are perpendicular, i.e. radially oriented, with respect to the eccentric rings guiding them at a given time only when they are in line with a line passing through the central axis of the power shaft and the centre of eccentricity of the eccentric ring arrangement.

SUMMARY OF THE INVENTION

An object of the invention is to develop the engine and the motor described above so as to enable the aforementioned problem to be solved. The object of the invention is achieved by a combustion engine and a hydraulic motor which are characterized in that the eccentric device or control comprises at least one guide groove which implements an eccentric path and to which the divider members are connected.

In a preferred embodiment, the guide groove is formed on a side surface of at least one guide disc fixedly mounted on the power shaft.

The invention is thus based on control or a control component which implements the eccentricity path of the divider members and which is most preferably implemented separately and wherein the eccentricity path may easily be provided such that the distance between the opposite matching surfaces of the divider members can always be kept constant by an appropriate shape of the guide groove, which is typically slightly different from a circular orbit, e.g. slightly elliptical. As distinct from the previous, this component implementing the eccentric control now rotates along with the power shaft, which also enhances the sealing contact of the divider members with the inner surface of the eccentric ring.

Instead, the basic operation of the device, i.e. the non-rotatoriness of the driving eccentric ring, remains exactly as before.

The solution according to the invention enables the previously problematic vibrations of the divider members and the resulting abnormal wear of the divider members and their matching surfaces to be eliminated. Now the running clearances of the divider members may easily be arranged appropriately and the operation of the seals provided at the ends of the divider members can be managed and thus the sealing effect be improved.

An additional advantage is that no inner eccentric ring that was previously used is necessary since, after all, its purpose was previously only to implement the control in question, in addition to the bearing system of the eccentric ring arrangement. It is now possible to mount the driving outer and only eccentric ring in bearings directly on the eccentric part of the power shaft.

Other preferred further developments and embodiments of the invention are disclosed in claims 3 to 11.

LIST OF FIGURES

The invention is now described in closer detail in connection with the preferred embodiments and with reference to the accompanying drawings, in which FIG. 1 shows a rotary combustion engine according to the invention when viewed in a transverse, i.e. radial, section;

DETAILED DESCRIPTION OF THE INVENTION

Figure 1:
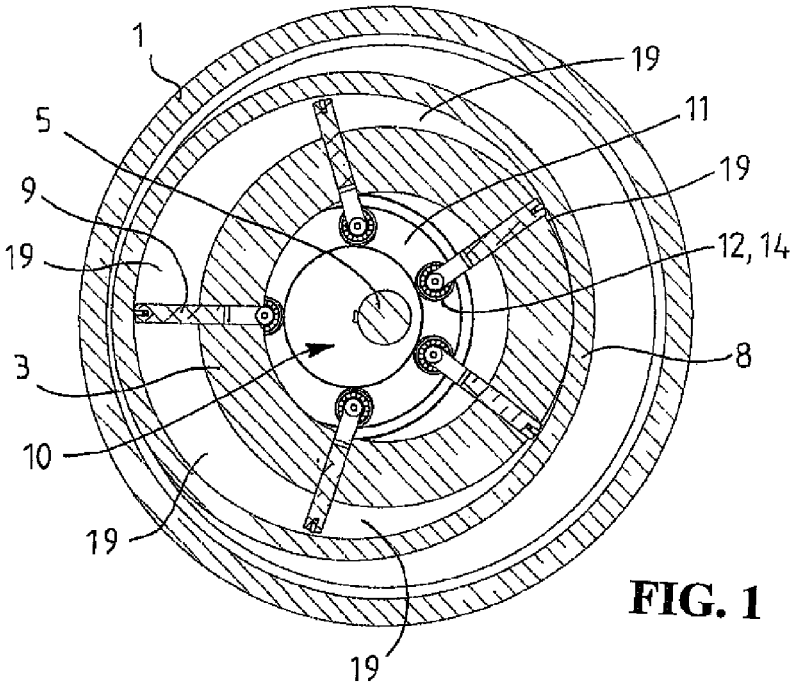
Figure 4:
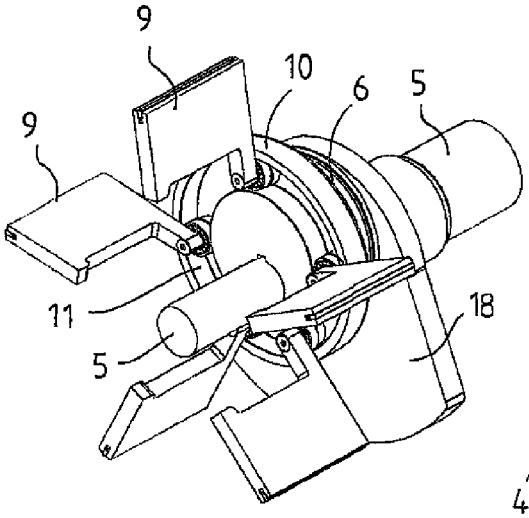
FIG. 4 is a perspective view showing a power shaft associated with the structure according to the previous figures, a guide disc fastened thereto, and divider members fastened to the guide disc.
Figure 2:
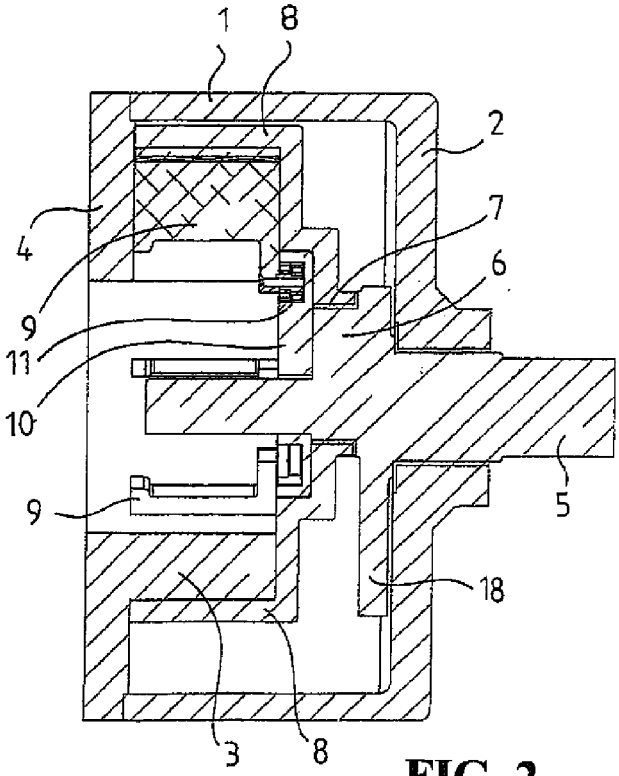
FIG. 2 shows the combustion engine according to FIG. 1 when viewed in a longitudinal, i.e. axial, section.
Figure 3:
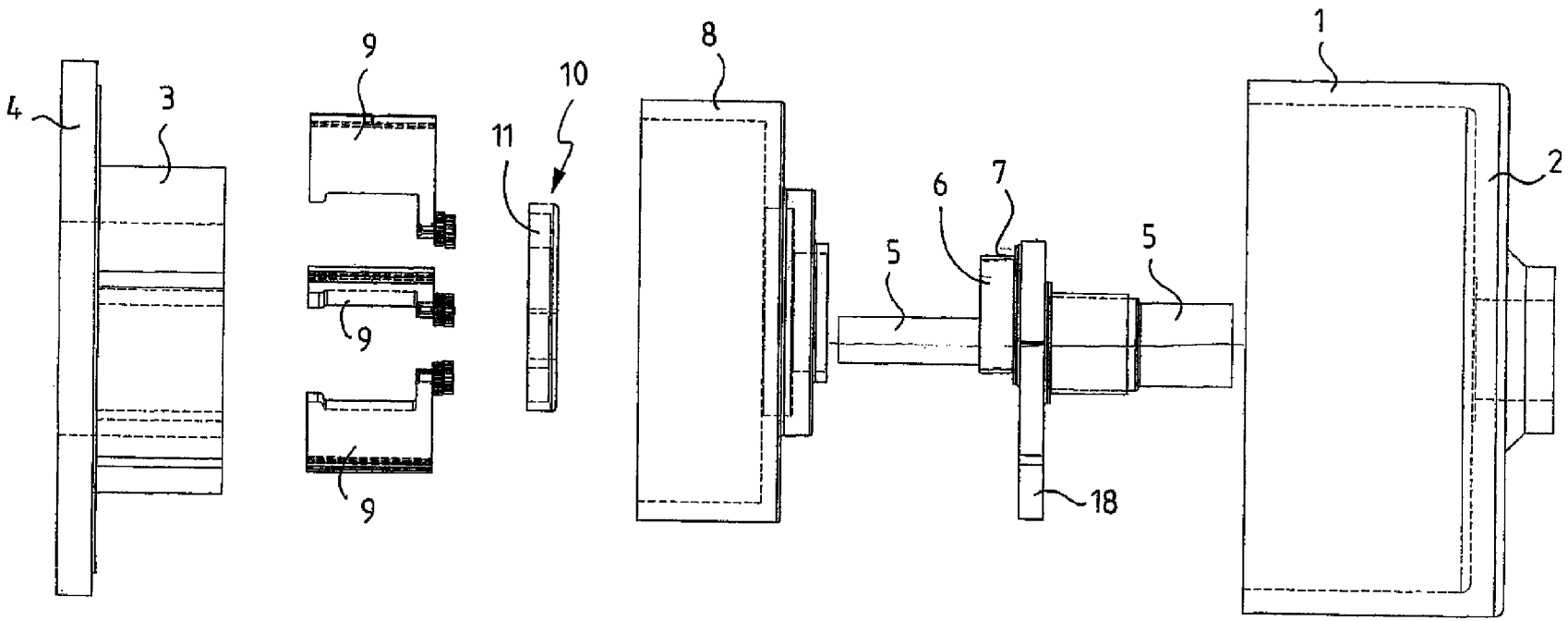
FIG. 3 is an exploded view showing the combustion engine according to the previous figures.
Figure 5:
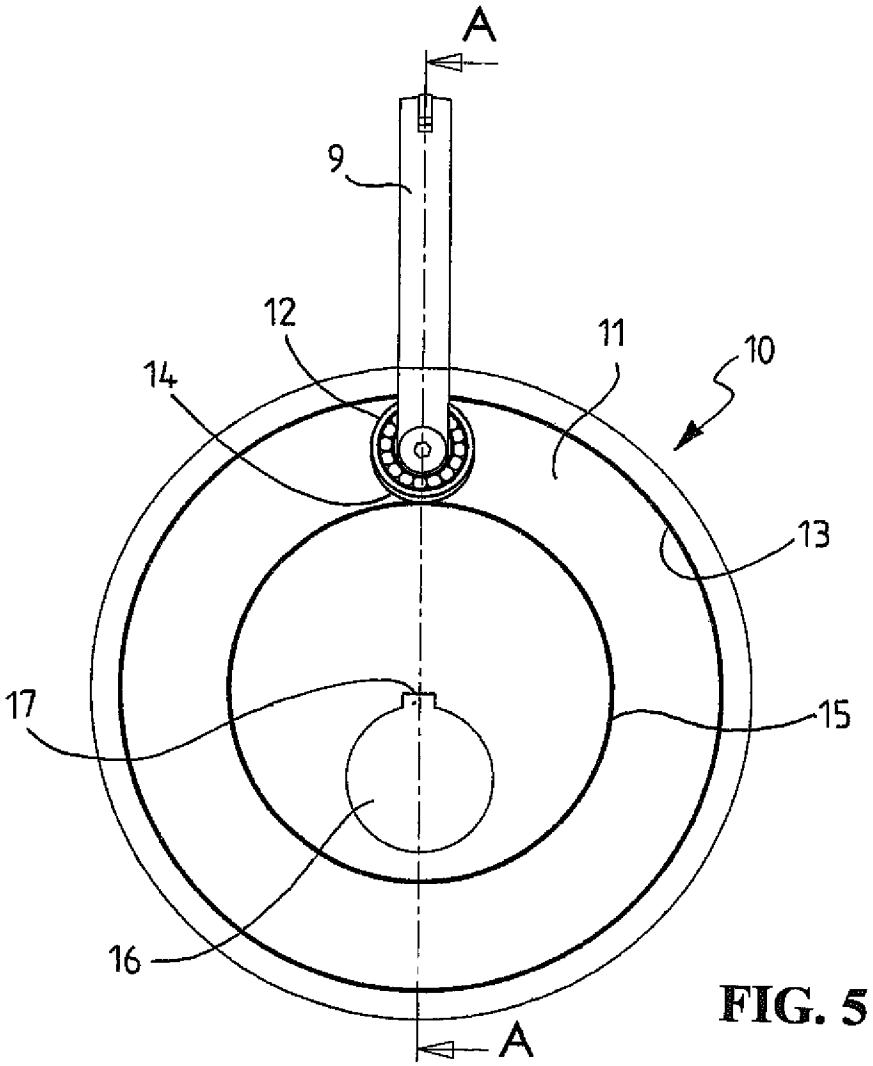
FIG. 5 is a side view showing a guide disc and one divider member associated therewith.
Figure 6:
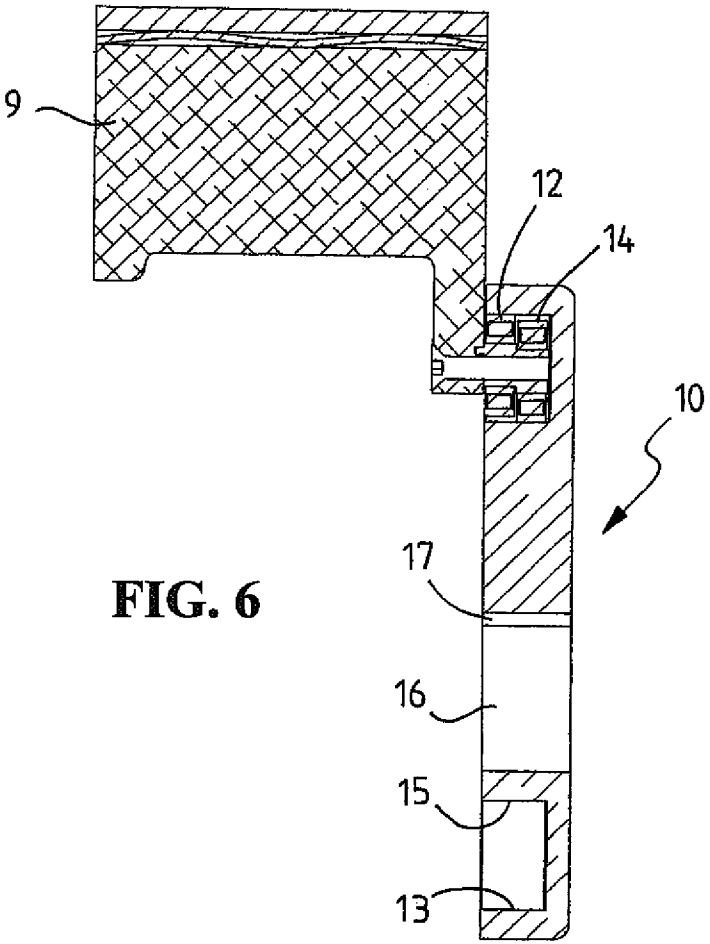
FIG. 6 shows section A-A of FIG. 5.

Referring first to FIGS. 1 to 3 in particular, a rotary engine shown therein comprises a non-rotary cylindrical outer casing 1 which is closed at its one end by a first end part 2, and a non-rotary inner casing 3 which, via a second end plate 4 provided at its one end, is fastened to one end edge of the outer casing 1. These components 1 to 4 mainly constitute the outer parts of the engine.

The components 1 to 4 encompass, first, a power shaft 5 arranged inside the inner casing 3 and mounted in bearings with respect to its centre line A coaxially with respect to the inner casing 3 to the end plates 2 and 4. The power shaft 5 is provided with an eccentric part 6, which is essential for the operation of the engine, and a bearing 7 is mounted on the surface thereof. A driving eccentric ring 8, which is also essential for the operation of the engine, is placed between the outer casing 1 and the inner casing 3, and it is mounted by the aforementioned bearing 7 on an eccentric part 6 of the power shaft 5.

A combustion chamber arrangement 19 is provided between the driving eccentric ring 8 and the inner casing 3 for burning a mixture of fuel and air supplied to the engine or for conveying hydraulic fluid thereto or therefrom such that the eccentric ring 8 drives the power shaft 5 by means of non-rotating eccentric movement only.

In this example, the combustion chamber arrangement 19 has been divided into five parts 19 of equal size by means of the divider members 9. The divider members 9 extend through the inner casing 3 and are in close contact with the inner surface of the driving eccentric ring 8.

It is necessary for the operation of the engine that it is provided with an eccentric device or control 10 for driving the divider members 9 back and forth with respect to the inner casing 3, whereby the eccentricity of the eccentric device or control 10 substantially corresponds with the eccentricity of the eccentric part 6 of the power shaft 5. This eccentric device or control 10 comprises a guide groove 11 which implements an eccentric path and to which the divider members 9 are connected. The guide groove 11 and the eccentric ring 8 are to remain concentric, as in the case of the previous two eccentric rings within each other known from Finnish Patents No. 110807 and 114235.

In this example, the guide groove 11 is formed on a side surface of the guide disc 10, whereby the guide disc 10 is fixedly mounted on the power shaft 5 such that the aforementioned concentric eccentricity between the eccentric ring 8 and the guide groove 11 is realized.

When the divider members 9 thus are, on one hand, arranged to be in close contact with the inner surface of the driving eccentric ring 8 and, on the other hand, connected to the power shaft 5 to the guide groove 11 of the fixedly connected guide disc 10, the divider members 9 move with respect to the inner casing 3 substantially radially, guided by the guide groove 11 of the guide disc 10, when the eccentric arrangement 8, 11 performs the eccentric movement. The fixed connection of the guide disc 10 with the power shaft 5 (which enables the power shaft 5 to rotate along) takes place by means of e.g. a locking slot 17 provided in an eccentric opening 16 of the guide disc 10 and a corresponding projection provided in the power shaft 5.

As already mentioned in the beginning, the distance between the sealing surface of the divider members 9 and the inner surface of the driving eccentric ring 8 does not remain constant since the divider members 9 are slightly inclined towards their matching surfaces for the most of the time; and they are perpendicular, i.e. radially oriented, with respect to the eccentric ring 8 at a given time only when they are in line with a line passing through the central axis of the power shaft 5 and the centre of eccentricity of the eccentric arrangement 8, 11. In order for the upper surface of the divider members 9 to closely follow the inner surface of the eccentric ring 8, the eccentric path of the control of the divider members 9, i.e. the aforementioned guide groove 11, may be formed typically slightly elliptical, whereby the focal points of the ellipse formed by the guide groove 11 are located on an axis which is perpendicular to a line passing through the central axis of the power shaft 5 and the centre of eccentricity of the eccentric arrangement 8, 11.

Two bearings 12, 14 successively located in the longitudinal direction of the power shaft 5 are connected to one lower edge of each divider member 9, the first one 12 being arranged to be in contact with an outer circumferential surface 13 of the guide groove 11 and the second one 14 with an inner circumferential surface 15 of the guide groove 11. This enables the outward and inward projecting action of the divider members 9 to be managed separately, whereby when the direction of projection changes, each bearing 12, 14 rotates in one direction only. In a system equipped with one bearing, the bearing would always change the direction of rotation when the direction of motion of the divider member 9 changes.

As to the combustion engine, the operation of the engine itself is simply such that by means of a gas exchange arrangement a burnable mixture is sucked in between the eccentric ring 8 and the inner casing 3, i.e. into spaces 19, the mixture being compressed into its smallest volume as the eccentric movement progresses, whereupon the mixture is ignited, as a result of which the explosion pressure pushes the eccentric ring 8 towards the outer casing 1, and so the eccentric movement of the eccentric ring 8 progresses between the inner and outer casings 1 and 3. In the case of a hydraulic motor, hydraulic liquid is fed into the spaces 19, and particularly when their volume is at its smallest, whereby the spaces start expanding and the eccentric movement progresses in a manner similar to that described in connection with the combustion engine. In this eccentric movement, the points of the eccentric ring 8 coming into contact with the casings 1 and 3 progress along the surfaces of the casings 1 and 3 in the direction of rotation of the power shaft 5. That is, these contact points "rotate", but the eccentric ring 8 itself does not rotate. This movement of the eccentric ring 8, in turn, rotates the power shaft 5 (or makes it rotate) by means of a second eccentric part mounted in bearings on the eccentric part 6 of the power shaft 5. The bearing 7 makes sure that the eccentric ring 8 will not start rotating.

In order to balance the eccentric forces, the power shaft 5 is provided with a counterbalance 18 which, with respect to the eccentric part 8 of the power shaft 5, is located on an opposite side of the power shaft 5. By dimensioning the mass of the counterbalance 18 appropriately, the vibration caused by the eccentric movement may be eliminated.

The gas exchange arrangement or the passage of the hydraulic fluid will not be described in closer detail herein since it has been disclosed in the aforementioned Finnish Patents No. 110807 and 114235.

The above description of the invention is only intended to illustrate the basic idea of the invention. However, it is obvious to one skilled in the art that this basic idea may be implemented in many different ways. The invention and its embodiments are thus not restricted to the above-described examples but they and the details thereof may vary considerably within the scope of the claims.

The invention claimed is:

1. A rotary combustion engine, comprising a non-rotary outer casing, a non-rotary inner casing, a power shaft provided with an eccentric part, a driving eccentric ring provided between the outer casing and the inner casing and mounted in bearings on the eccentric part of the power shaft, a combustion chamber arrangement that burns a mixture of fuel and air supplied into the engine between the driving eccentric ring and the inner casing such that the driving eccentric ring drives the power shaft by means of substantially non-rotating eccentric movement, divider members that divide the combustion chamber arrangement into at least two parts of equal size, whereby the divider members extend through the inner casing and are in close contact with an inner surface of the driving eccentric ring, an eccentric device or control that drives the divider members back and forth with respect to the inner casing, whereby the eccentricity of the eccentric device or control corresponds with the eccentricity of the eccentric part of the power shaft, wherein the eccentric device or control comprises at least one guide disc having at least one guide groove which implements an eccentric path and to which the divider members are connected;

the eccentric path implemented by the guide groove is elliptical; and the guide groove is formed in a side surface of the at least one guide disc mounted fixedly on the power shaft.

2. An engine as claimed in claim 1, wherein the number of guide discs is one, and the guide disc is located next to the eccentric part.

3. An engine as claimed in claim 1, wherein the number of guide discs is two, one on each side of the divider members.

4. An engine as claimed in claim 1, wherein the guide groove is formed on a side surface of the eccentric part.

5. An engine as claimed in claim 1, wherein each divider member is connected to a respective guide groove via at least one bearing fastened to the divider member.

6. An engine as claimed in claim 5, wherein a first and a second bearing successively located in the longitudinal direction of the power shaft are connected to each divider member, the first bearing being arranged to be in contact with an outer circumferential surface of the guide groove and the second bearing arranged to be in contact with an inner circumferential surface of the guide groove.

7. An engine as claimed in claim 1, wherein each divider member is connected to a respective guide groove via at least one slide member fastened to the divider member.

8. An engine as claimed in claim 1, wherein the focal points of the elliptical eccentric path are located on an axis which is perpendicular to a line passing through the central axis of the power shaft and a centre of eccentricity of the driving eccentric ring and the guide groove.

9. A hydraulic motor, comprising a non-rotary outer casing, a non-rotary inner casing, a power shaft provided with an eccentric part, a driving eccentric ring provided between the outer casing and the inner casing and mounted in bearings on the eccentric part of the power shaft, a pressure chamber arrangement between the driving eccentric ring and the inner casing that conveys hydraulic fluid thereto and therefrom such that the driving eccentric ring drives the power shaft by means of substantially non-rotating eccentric movement, divider members that divide the pressure chamber arrangement into at least two parts of equal size, whereby the divider members extend through the inner casing and are in close contact with an inner surface of the driving eccentric ring, an eccentric device or control that drives the divider members back and forth with respect to the inner casing, whereby an eccentricity of the eccentric device or control corresponds with an eccentricity of the eccentric part of the power shaft, wherein the eccentric device or control comprises at least one guide disc having at least one guide groove which implements an eccentric path and to which the divider members are connected;

the eccentric path implemented by the guide groove is elliptical; and the guide groove is formed in a side surface of the at least one guide disc mounted fixedly on the power shaft.

10. A motor as claimed in claim 9, wherein the number of guide discs is one, and the one guide disc is located next to the eccentric part.

11. A motor as claimed in claim 9, wherein the number of guide discs is two, one on each side of the divider members.

12. A motor as claimed in claim 9, wherein the guide groove is formed on a side surface of the eccentric part.

13. A motor as claimed in claim 9, wherein each divider member is connected to a respective guide groove via at least one bearing fastened to the divider member.

14. A motor as claimed in claim 13, wherein a first and a second bearing successively located in the longitudinal direction of the power shaft are connected to each divider member, the first bearing being arranged to be in contact with an outer circumferential surface of the guide groove and the second bearing being arranged to be in contact with an inner circumferential surface of the guide groove.

15. A motor as claimed in claim 9, wherein each divider member is connected to a respective guide groove via at least one slide member fastened to the divider member.

16. A motor as claimed in claim 9, wherein the focal points of the elliptical eccentric path are located on an axis which is perpendicular to a line passing through the central axis of the power shaft and a centre of eccentricity of the driving eccentric ring and the guide groove.

* * * * *